US008038270B2

(12) United States Patent
Nakazawa

(10) Patent No.: US 8,038,270 B2
(45) Date of Patent: Oct. 18, 2011

(54) LIQUID EJECTING DEVICE

(75) Inventor: Fumio Nakazawa, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 484 days.

(21) Appl. No.: 12/199,699

(22) Filed: Aug. 27, 2008

(65) Prior Publication Data

US 2009/0058894 A1 Mar. 5, 2009

(30) Foreign Application Priority Data

Aug. 27, 2007 (JP) ..... 2007-219285

(51) Int. Cl.
*B41J 2/175* (2006.01)

(52) U.S. Cl. ..... 347/85; 347/92; 347/84

(58) Field of Classification Search ..... 347/84, 347/85, 86, 92, 93, 20
See application file for complete search history.

(56) References Cited

U.S. PATENT DOCUMENTS

| | | | | |
|---|---|---|---|---|
| 6,755,500 | B2 * | 6/2004 | Hirano et al. | 347/85 |
| 2006/0137526 | A1 | 6/2006 | Ueda | |
| 2007/0046747 | A1 * | 3/2007 | Takemoto | 347/92 |
| 2007/0222828 | A1 * | 9/2007 | Stathem et al. | 347/85 |

FOREIGN PATENT DOCUMENTS

| | | | |
|---|---|---|---|
| JP | 2005288770 | A | 10/2005 |
| JP | 2006206190 | A | 8/2006 |

* cited by examiner

*Primary Examiner* — Manish S Shah
(74) *Attorney, Agent, or Firm* — Baker Botts L.L.P.

(57) ABSTRACT

A liquid ejecting device is provided. The liquid ejecting device includes: a liquid ejecting head configured to eject a liquid; a liquid supply channel configured to supply the liquid to the liquid ejecting head; a discharge channel communicating with the liquid supply channel through a communicating portion; a suction unit connected to the discharge channel so as to perform a suction operation of suctioning gas from the discharge channel; a gas permeable film disposed in the communicating portion between the liquid supply channel and the discharge channel; a vibration driving unit configured to vibrate the gas permeable film; and a controller configured to control the suction unit and the vibration driving unit.

12 Claims, 10 Drawing Sheets

LIQUID EJECTING DEVICE

CROSS-REFERENCE TO RELATED APPLICATION

This application claims priority from Japanese Patent Application No. 2007-219285, filed on Aug. 27, 2007, the entire subject matter of which is incorporated herein by reference.

TECHNICAL FIELD

Aspects of the present invention relate to a liquid ejecting device including a liquid ejecting head for ejecting a liquid.

BACKGROUND

An ink-jet printing device has been known as a liquid ejecting device ejecting a liquid. In such ink-jet printing device, ink supplied from an ink cartridge is temporarily stored in a sub-tank and then is supplied to a print head. At this time, if bubbles mixed into the sub-tank are supplied to the print head along with the ink, the printing failure occurs. Therefore, the sub-tank is connected to a deaeration pump through a gas permeable film passing gas but not passing ink or solid other than the gas, and the inside of the sub-tank is depressurized by actuating the deaeration pump to discharge the bubbles in the sub-tank (For example, see JP-A-2005-288770).

The gas permeable film is made of a porous member having plural minute pores through which only gas not destructing a meniscus of ink can pass. In the ink-jet printing device described in JP-A-2005-288770, at the time of suctioning bubbles, the ink in the sub-tank enters the pores of the gas permeable film and is dried and thickened. Then, the pores to which the thickened ink is attached cannot pass the bubbles to cause the clogging, whereby a gas permeable area thereof is reduced. In this state, when the bubbles are repeatedly suctioned through the gas permeable film, the clogging is further enhanced and the gas permeable area is further reduced. Finally, the gas permeable film cannot pass the gas.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a liquid ejecting device which can reduce the clogging due to attachment of a liquid at the time of suction operation and can elongate the gas permeability of a gas permeable film.

According to an exemplary embodiment of the present invention, there is provided a liquid ejecting device including: a liquid ejecting head configured to eject a liquid; a liquid supply channel configured to supply the liquid to the liquid ejecting head; a discharge channel communicating with the liquid supply channel through a communicating portion; a suction unit connected to the discharge channel so as to perform a suction operation of suctioning gas from the discharge channel; a gas permeable film disposed in the communicating portion between the liquid supply channel and the discharge channel; a vibration driving unit configured to vibrate the gas permeable film; and a controller configured to control the suction unit and the vibration driving unit.

According to another exemplary embodiment of the present invention, there is provided a liquid tank including: a liquid containing unit which contains a liquid and supplies the liquid to an ejecting head which ejects the liquid, the liquid containing unit including a gas discharge opening; a gas permeable film which covers the gas discharge opening; a discharge channel, one end of which communicates with the liquid tank through the gas discharge opening, and the other end of which is connectable to a suction pump which suctions air in the liquid containing unit through the discharge channel; and a vibration driving unit which vibrates the gas permeable film.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Figure 1:
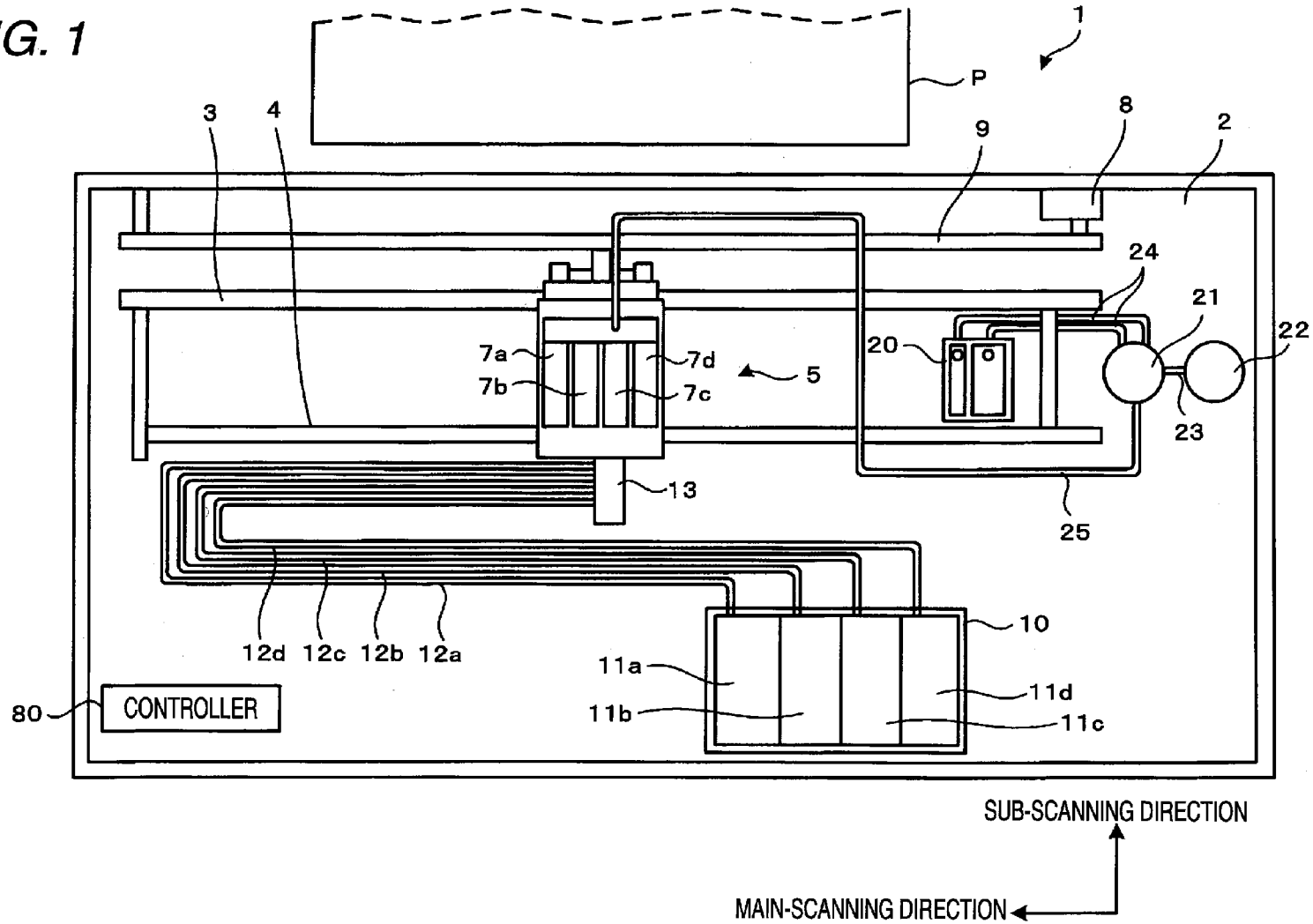
FIG. 1 is a plan view schematically illustrating a configuration of an ink-jet printer according to an exemplary embodiment of the invention.

Hereinafter, an exemplary embodiment of the invention will be described with reference to the accompanying drawings. In this exemplary embodiment, the inventive concept of the present invention is applied to an ink-jet printer for ejecting ink onto a printing sheet to print desired characters or images thereon. FIG. 1 is a plan view schematically illustrating a configuration of an ink-jet printer according to the exemplary embodiment of the invention. In the following description, the horizontal direction in FIG. 1 is defined as a main scanning direction and the direction from down to up is defined as a sub-scanning direction. The sub-scanning direction is perpendicular to the main scanning direction.

As shown in FIG. 1, the ink-jet printer 1 as an exampled of a liquid ejecting device has two guide shafts 3 and 4 extending in the main scanning direction in a body case 2. A carriage 5 is mounted on the two guide shafts 3 and 4 so as to reciprocate in the main scanning direction. A carriage motor 8 is disposed in the body case 2, and an endless belt 9 is wound around a driving shaft of the carriage motor 8. The endless belt 9 is coupled to the carriage 5. The carriage motor 8 drives to move the endless belt 9 so that the carriage 5 reciprocates in the main scanning direction.

Four sub-tanks 7*a* to 7*d* arranged in the main scanning direction are mounted on the carriage 5. The sub-tanks 7*a* to 7*d* contain black ink, yellow ink, magenta ink, and cyan ink supplied from ink cartridges 11*a* to 11*d* to be described later, respectively. The bottom surfaces of the four sub-tanks 7*a* to 7*d* are provided with an inkjet head 6 as an example of a liquid ejecting head connected to the sub-tanks 7*a* to 7*d* through flow channels (see FIG. 4). That is, the carriage 5 is mounted with the sub-tanks 7*a* to 7*d* and the ink-jet head 6.

The ink-jet head 6 includes plural nozzles (not shown) and ejects ink from the plural nozzles onto a printing sheet P fed by a feeding mechanism (not shown) to the downside of the carriage 5 (in the depth direction perpendicular to the paper plane of FIG. 1). A tube joint 13 is fixed to an end (the downside in FIG. 1) in the sub-scanning direction of the carriage 5.

Figure 2:
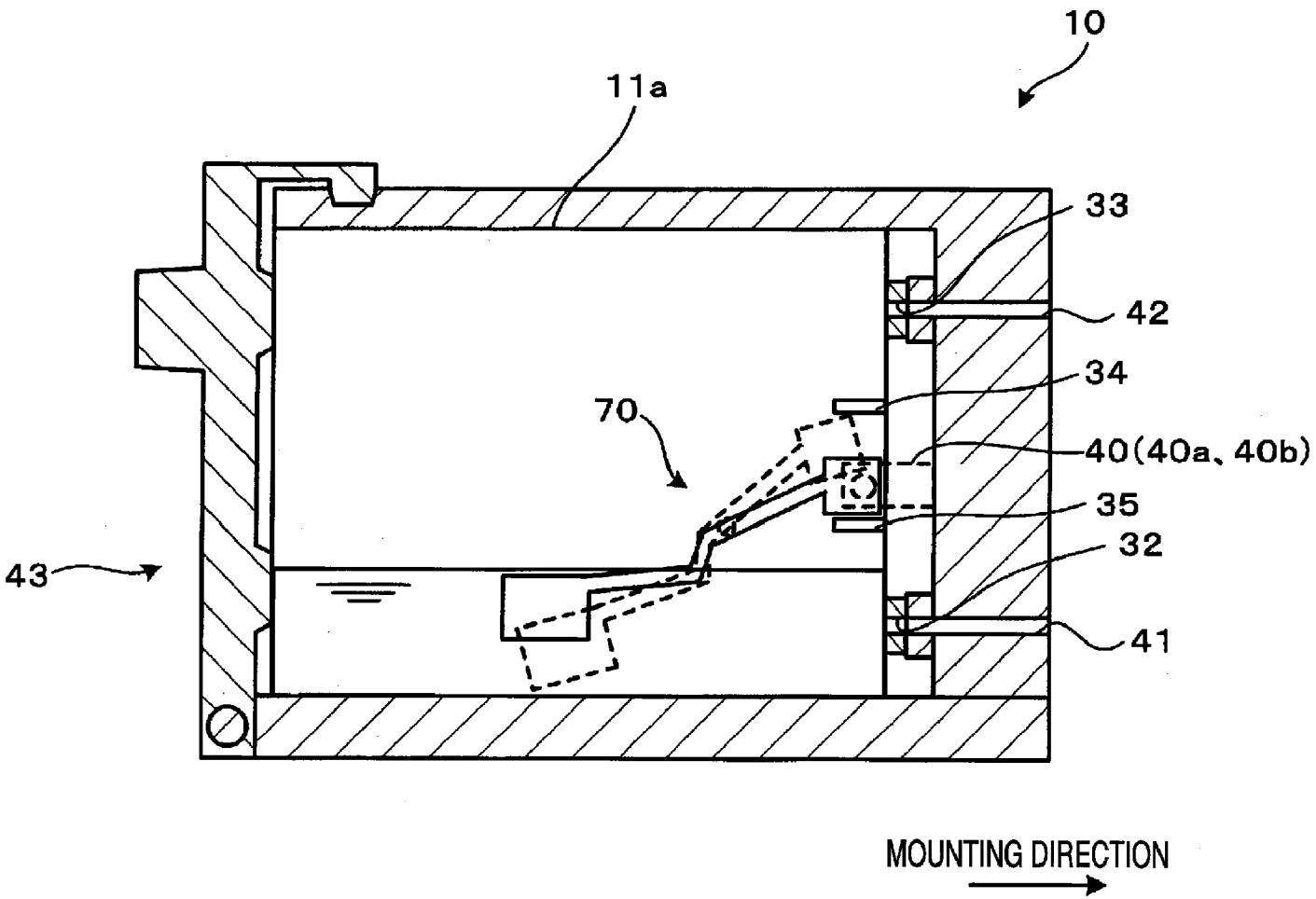
FIG. 2 is a longitudinal sectional view of an ink cartridge mounted on a holder.

A holder 10 is fixed in the bottom surface of the body case 2 and four ink cartridges 11*a* to 11*d* are detachably mounted on the holder 10 (see FIG. 2). The ink cartridges 11*a* to 11*d* contain the black ink, the yellow ink, the magenta ink, and the cyan ink, respectively. The ink contained in the ink cartridges 11*a* to 11*d* is supplied to the sub-tank 7*a* to 7*d* through flexible ink tubes 12*a* to 12*d* and the tube joint 13, is temporarily stored in the sub-tanks 7*a* to 7*d*, and then is supplied to the ink-jet head 6.

In the body case 2, a suction cap 20, a switching unit 21, and a suction pump 22 are disposed at one end in the moving direction of the carriage 5 (the right side of FIG. 1). The suction pump 22 is connected to the switching unit 21 through a tube 23. The switching unit 21 is connected to the suction cap 20 through a tube 24 and is connected to a discharge channel 51 (see FIG. 4) formed in the sub-tanks 7*a* to 7*d* through a flexible tube 25, which will be described later. The switching unit 21 selectively switches between a state where the suction pump 22 is connected to the discharge channel 51 and a state where the suction pump 22 is connected to the suction cap 20.

The suction cap 20 is disposed at a position overlapping with the carriage 5 in the right side in FIG. 1 in a movable range of the carriage 5 in the main scanning direction in a plan view. The suction cap 20 moves upward (in the direction perpendicular to the paper plane of FIG. 1) to cover the bottom surface of the ink-jet head 6, when the carriage 5 moves in the main scanning direction to a position where the ink-jet head 6 faces the suction cap 20. Then, the plural nozzles formed in the bottom surface of the ink-jet head 6 are covered with the suction cap 20 and the suction pump 22 suctions the ink in the inkjet head 6 from the plural nozzles in this state.

The suction pump 22 is selectively connected to one of the discharge channel 51 and the suction cap 20 by the switching unit 21. When the suction pump 22 is connected to the discharge channel by the switching unit 21, the suction pump suctions the gas in the discharge channel 51. On the other hand, when the suction pump 22 is connected to the suction cap 20 by the switching unit 21, the suction pump reduces the pressure in the space surrounded with the ink-jet head 6 and the suction cap 20 in the state where the bottom surface of the ink-jet head 6 is covered with the suction cap 20, thereby suctioning the ink in the ink-jet head 6 from the plural nozzles. The ink cartridges 11*a* to 11*d* and the holder 10 will be described with reference to FIG. 2. Since four ink cartridges 11*a* to 11*d* have the same configuration, only the ink cartridge 11*a* is described below. FIG. 2 is a longitudinal sectional view schematically illustrating the ink cartridge 11*a* mounted on the holder 10.

As shown in FIG. 2, the ink cartridge 11*a* is made of synthetic resin (for example, plastic) having a substantially rectangular shape and a light transmitting property and contains ink therein. The ink cartridge 11*a* includes an ink discharge port 32, an air inlet port 33, and a sensor arm 70. The ink discharge port 32 supplies ink to the sub-tank 7*a* through an ink discharge hole 41 formed in the holder 10 and a tube 12*a*. The air inlet port 33 supplies air into the ink cartridge 11*a* through an air introduction hole 42 formed in the holder 10. The sensor arm 70 can rotate about its axis depending on the ink level and blocks light. The upward and downward movement thereof is regulated by stoppers 34 and 35.

The holder 10 is fixed to the bottom of the body case 2. The ink cartridge 11*a* is inserted into the holder 10 from the left side in FIG. 2 and is mounted thereon by covering a cover 43. The holder 10 has an optical sensor 40. The optical sensor 40 includes a light emitting element 40*a* and a light receiving element 40*b* with both side surfaces (the front and deep surfaces with respect to the paper plane of FIG. 2) of the ink cartridge 11*a* interposed therebetween and detects an amount of ink remaining in the ink cartridge 11*a*.

When a sufficient amount of ink is contained in the ink cartridge 11*a*, light emitted from the light emitting element 40*a* is blocked by the sensor arm 70 and is not received by the light receiving element 40*b*. When the ink level is lowered with the decrease in ink of the ink cartridge 11*a*, the sensor arm 70 moves to the upper stopper 34. Then, the sensor arm 70 is not located on a virtual line connecting the light emitting element 40*a* to the light receiving element 40*b* and thus the light emitted from the light emitting element 40*a* is received by the light receiving element 40*b*. The amount of remaining ink is detected depending on the receiving state of light by the light receiving element 40*b*. That is, when the light emitted from the light emitting element 40*a* is not received by the light receiving element 40*b*, it is detected that the ink sufficiently remains. When the light emitted from the light emitting element 40*a* is received by the light receiving element 40*b*, it is detected that the amount of remaining ink is small.

Figure 3:
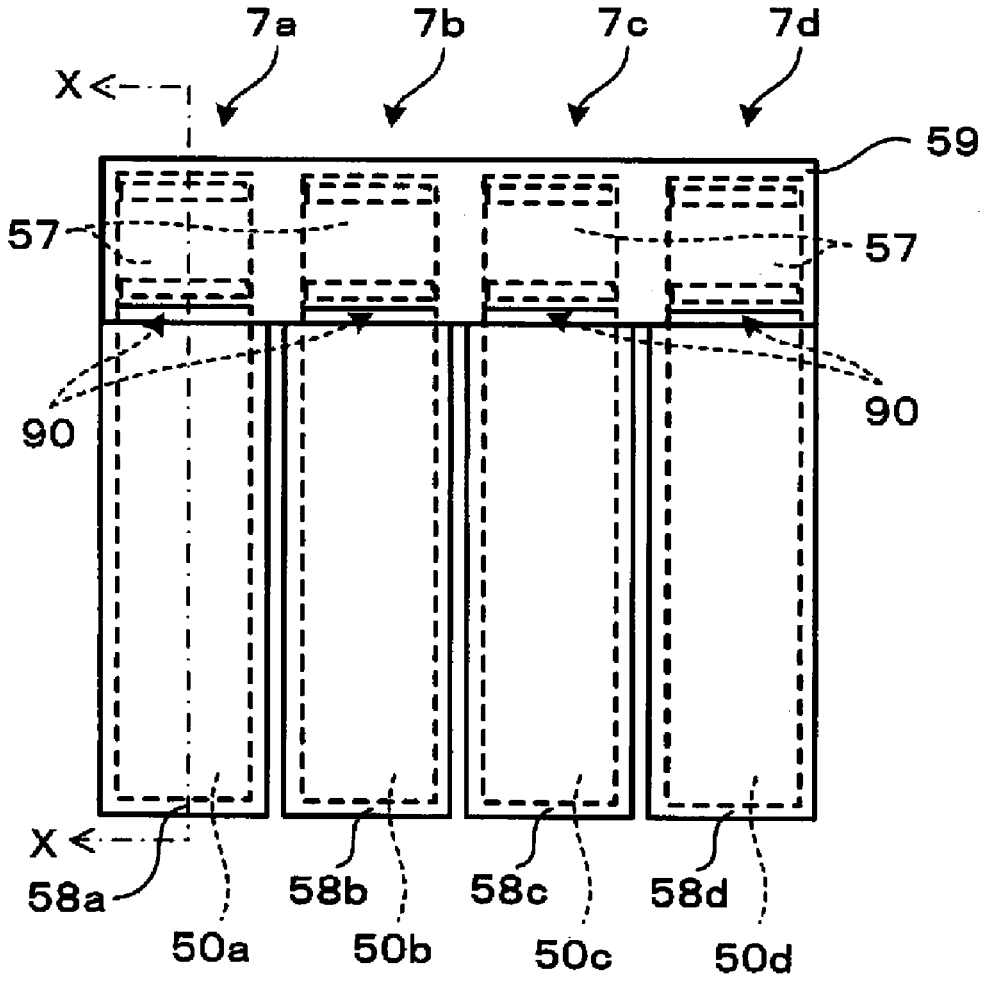
FIG. 3 is a top view schematically illustrating a sub-tank.
Figure 4:
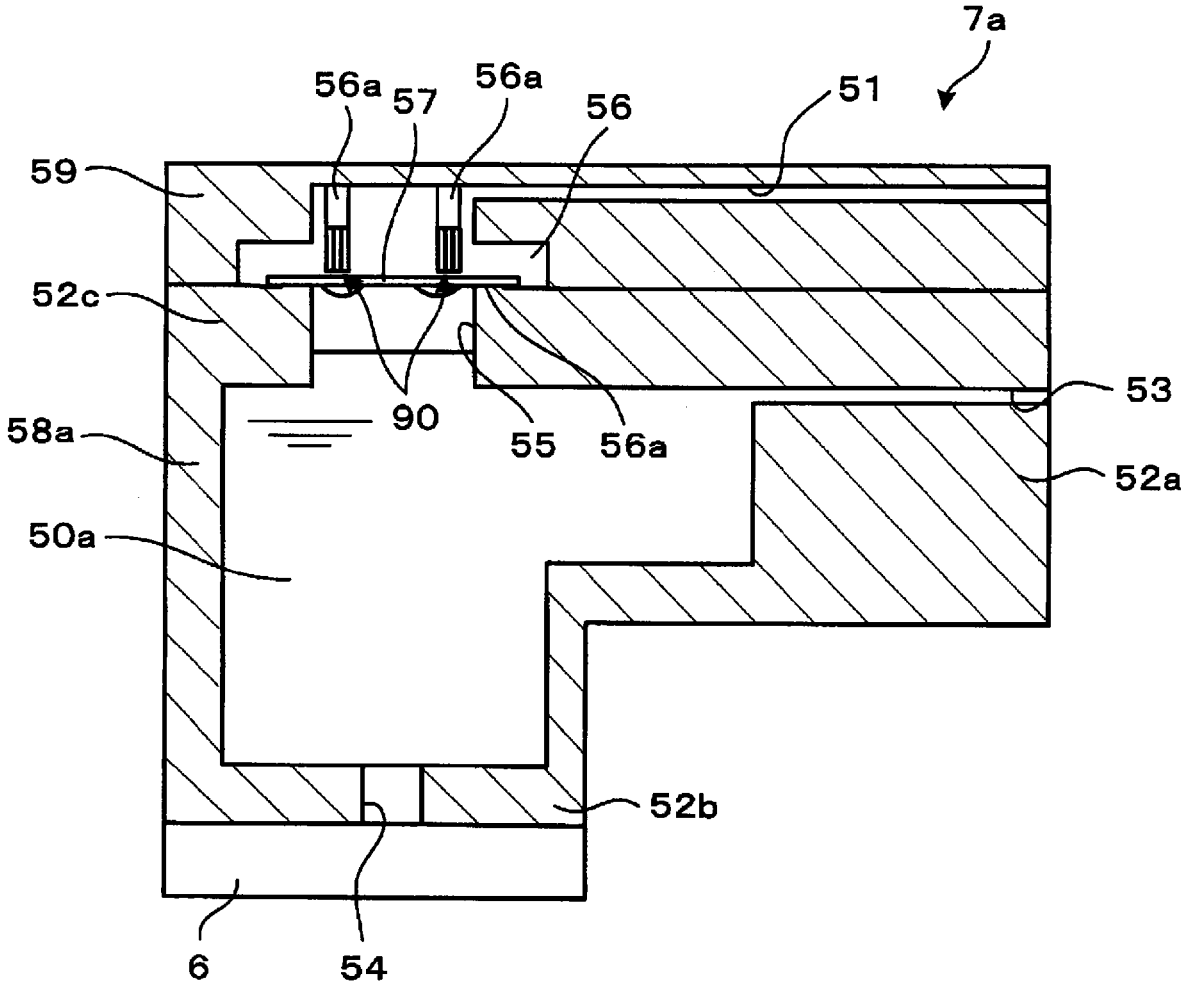
FIG. 4 is a sectional view taken along line X-X of FIG. 3.

When it is detected that the amount of ink remaining in the ink cartridge 11*a* is small, a user can remove the ink cartridge 11*a* from the holder 10 and mount a new ink cartridge 11*a* containing a sufficient amount of ink. Then, the light emitted from the light emitting element 40*a* is blocked by the sensor arm 70 of the newly mounted ink cartridge 11*a* and is not received by the light receiving element 40*b*. That is, when the light emitted from the light emitting element 40*a* is not first received by the light receiving element 40*b*, is then received thereby, and then is not received thereby, it can be determined that the ink cartridge 11*a* is replaced. The sub-tanks 7*a* to 7*d* will be described now with reference to FIGS. 3 and 4. FIG. 3 is a top view schematically illustrating the sub-tanks. FIG. 4 is a sectional view taken along line X-X of FIG. 3.

As shown in FIG. 3, the sub-tanks 7*a* to 7*d* have tank bodies 58*a* to 58*d*, respectively, and a cover member 59 is disposed on the top surfaces at ends in the longitudinal direction of the tank bodies 58*a* to 58*d*. That is, the tank bodies 58*a* to 58*d* form the sub-tanks 7*a* to 7*d* together with a part of the cover member 59, respectively. Ink containing portions 50*a* to 50*d* containing ink supplied from the ink cartridges 11*a* to 11*d* through the ink tubes 12*a* to 12*d* are formed in the tank bodies 58*a* to 58*d*, respectively.

Since four sub-tanks 7*a* to 7*d* have the same configuration, the sub-tank 7*a* containing the black ink will be described below as an example. As shown in FIG. 4, an ink inlet port 53 extending in the horizontal direction is formed at the center portion of a right side wall 52*a* of the tank body 58*a* in FIG. 4. An ink supply hole 54 is formed in a bottom wall 52*b* of the tank body 58*a*. The inkjet head 6 is disposed below the tank body 58*a* so as to allow the ink supply hole 54 to communicate with the ink-jet head 6. The ink supplied into the ink-jet head 6 from the ink containing portion 50*a* through the ink supply hole 54 is ejected from plural nozzles through an ink flow channel (not shown) formed in the ink-jet head 6.

That is, the ink containing portion 50*a*, the ink inlet port 53, and the ink supply hole 54 form a liquid supply channel for supplying ink to the ink-jet head 6. The ink supply hole 54 as an end of the liquid supply channel is connected to the ink-jet head 6 and the ink inlet port 53 as the other end is connected to the ink discharge port 32 of the ink cartridge 11*a* through the ink tube 12*a* and the ink discharge hole 41 of the holder 10. Accordingly, the ink is supplied from the ink cartridge 11*a* to the ink containing portion 50*a* in the tank body 58*a*. When the ink is ejected (consumed) from the nozzles, the amount of ink in the ink containing portion 50*a* is reduced with the supply to the ink-jet head 6, and therefore, the pressure of the ink containing portion 50*a* is reduced. However, since the inside of the ink cartridge 11*a* communicates with the atmospheric air through the air inlet port 33 and is maintained in the atmospheric pressure, ink is replenished into the ink containing portion 50*a*.

An opening 55 is formed in a top wall 52*c* of the tank body 58*a*. A gas permeable film 57 is bonded to the top surface 59*a* of the tank body 58*a* by thermal bonding or adhesion so as to cover the opening 55. The gas permeable film 57 passes gas but does not pass ink or solid other than the gas, and is made of, for example, a porous fluorine resin film.

A discharge chamber 56 and a discharge channel 51 are formed in the cover member 59. The discharge chamber 56 is a concave portion formed in the bottom surface of the cover member 59 so as to cover the opening 55 formed in the tank bodies 58*a* to 58*d*. The discharge channel 51 is formed in the horizontal direction in the top portion of the discharge chamber 56. The discharge channel 51 is connected to the suction pump 22 through the tubes 23 and 25 and the switching unit 21. That is, the ink containing portion 50*a* as a part of the liquid supply channel communicates with the discharge channel 51 and the gas permeable film 57 is disposed therebetween. In this exemplary embodiment, the opening 55 and the discharge chamber 56 serve as the flow channel forming member constituting the communication portion between the ink containing portion 50*a* and the discharge channel 51. Accordingly, the gas in the ink containing portion 50*a* passes through the gas permeable film 57 and is suctioned by the suction pump 22 through the discharge channel 51 and the tubes 23 and 25. At this time, when the gas in the ink containing portion 50*a* is suctioned, the gas permeable film 57 prevents the ink from being suctioned together with the gas.

Two protruding portions 56*a* protruding downward are provided on the top portion of the discharge chamber 56. Two dielectric elastomers 90 which vibrate the gas permeable film 57 are bonded to the bottom surfaces of the two protruding portions 56*a*, respectively.

Figure 5A:
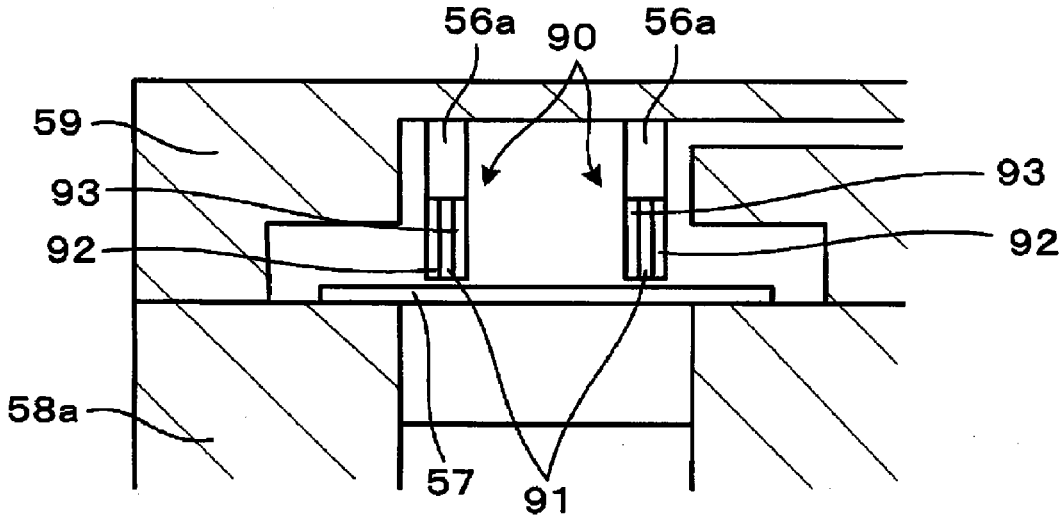
FIGS. 5A and 5B are enlarged views of the periphery of a dielectric elastomer shown in FIG. 4.
Figure 5B:
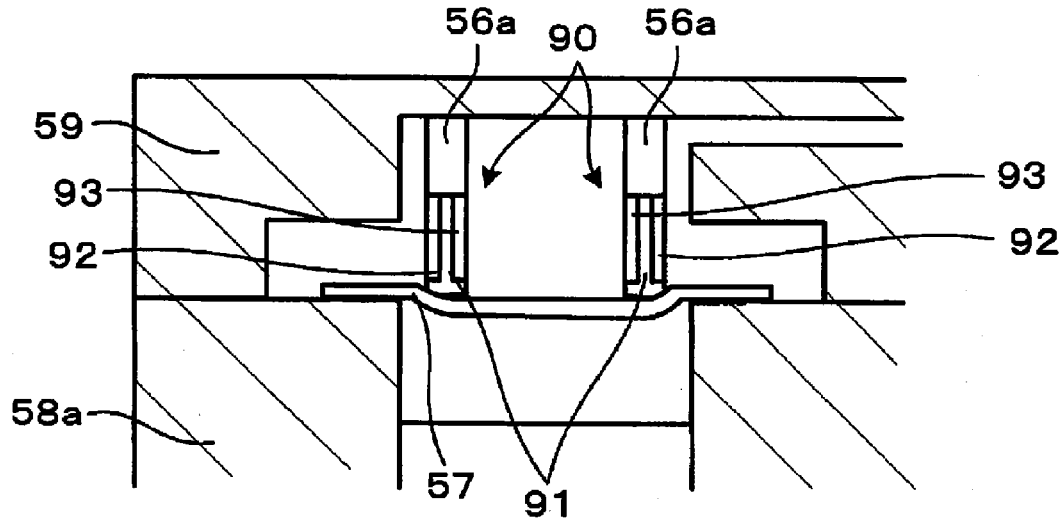

The dielectric elastomer 90 will be described now with reference to FIGS. 5A and 5B. FIGS. 5A and 5B are enlarged views of the periphery of the dielectric elastomer shown in FIG. 4.

As shown in FIG. 5A, the dielectric elastomer 90 includes a base member 91 made of high-elasticity polymer elastomer such as silicon resin or acryl silicon polymer and two electrodes 92 and 93 provided on both surfaces of the base member 91. One end of the base member 91 (upper end in FIG. 5A) is bonded to the bottom surface of the protruding portion 56*a*. The end of the base member 91 opposite to the bonding end is separated from the gas permeable film 57 with a specific gap therebetween. When the base member 91 made of polymer elastomer is placed in a strong electric field, the base member 91 is contracted in the direction parallel to the electric field and is expanded in the direction perpendicular to the electric field. Two electrodes 92 and 93 are made of, for example, Al, Cu, or Au having a good affinity for the base member 91 formed of the polymer elastomer.

In the dielectric elastomer 90, when a voltage is applied across two electrodes 92 and 93, an attractive force is generated between two electrodes 92 and 93 and thus the base member 91 is pressed in the thickness direction with the attractive force. That is, as shown in FIG. 5A, when the voltage is not applied across the electrodes 92 and 93, the base member 91 is not deformed and a specific gap is formed between the base member 91 and the gas permeable film 57. When the voltage is applied across the electrodes 92 and 93, the base member 91 is contracted in the direction (thickness direction) in which the electrodes 92 and 93 face each other and the base member 91 is expanded from one side face (the downside in FIG. 5B) of the dielectric elastomer 90 in the direction perpendicular to the thickness direction. Accordingly, the expanded base member 91 comes in contact with the top surface of the gas permeable film 57 and presses down the gas permeable film 57 with further expansion. Thereafter, when the application of a voltage across the electrodes 92 and 93 is stopped, the base member 91 is restored to the original state where the specific gap is formed between the base member 91 and the gas permeable film 57 as shown in FIG. 5A. In this way, by repeating the application of voltage across the electrodes 92 and 93 at a small interval of time, the base member 91 repeats expansion and contraction, thereby allowing the gas permeable film 57 to vibrate.

Figure 6:
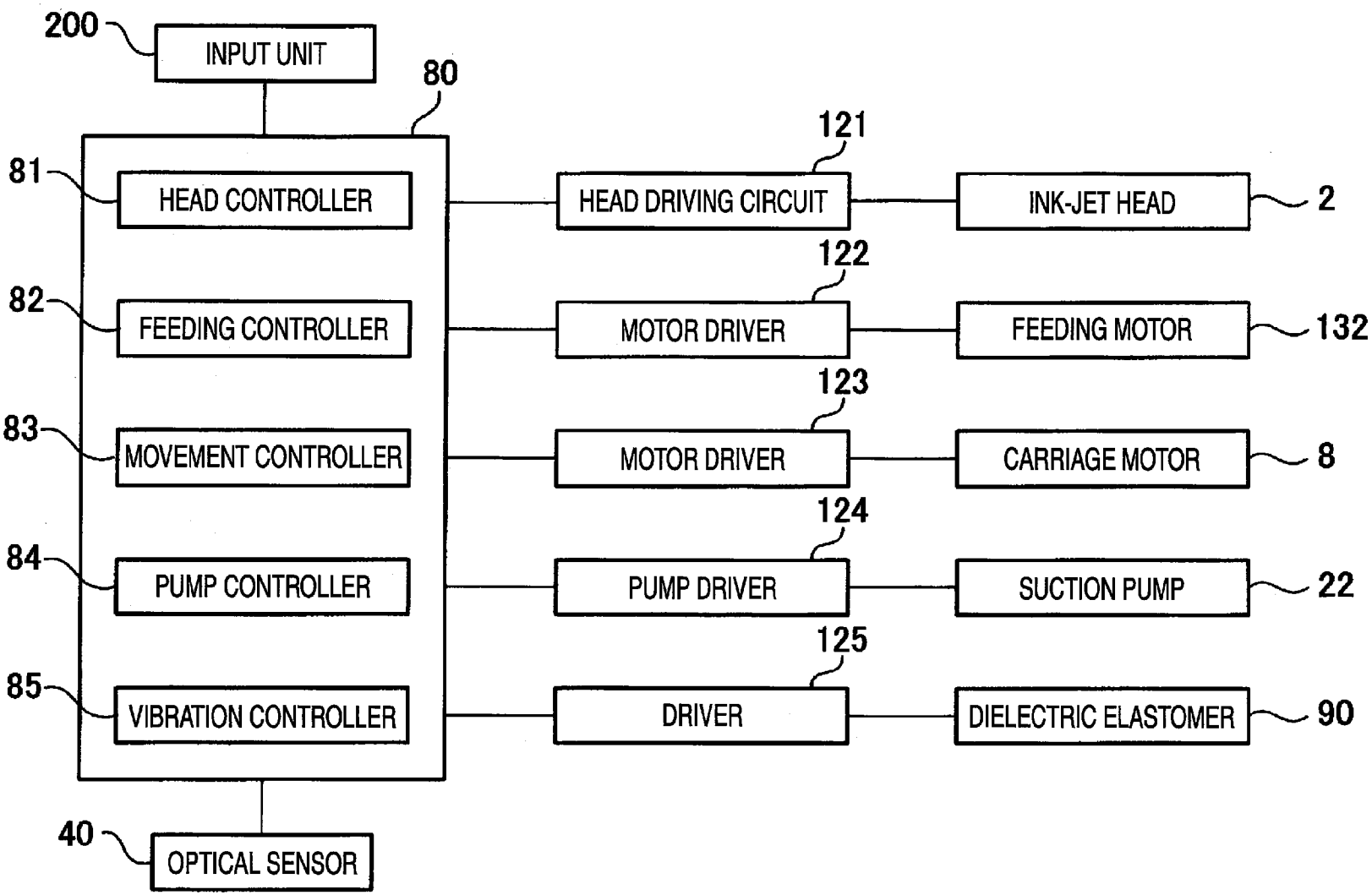
FIG. 6 is a block diagram illustrating an electrical configuration of the ink-jet printer.

An electrical configuration of the ink-jet printer 1 will be described with reference to FIG. 6. FIG. 6 is a block diagram illustrating an electrical configuration of the ink-jet printer 1. As shown in FIG. 6, the ink-jet printer 1 includes a controller 80 controlling the entire operations thereof. The controller 80 includes a central processing unit (CPU), a Read Only Memory (ROM) storing various programs or data for controlling the entire operations of the ink-jet printer 1, a Random Access Memory (RAM) temporarily storing data processed by the CPU, and an input/output interface.

The controller 80 includes a head controller 81, a feeding controller 82, a movement controller 83, a pump controller 84, and a vibration controller 85. The controller 80 determines whether the suction operation should be started.

The head controller 81 controls a head driving circuit 121 to eject the ink from the ink-jet head 6, when print data from an input unit 200 such as a PC is received by the controller 80.

The feeding controller 82 controls a motor driver 122 to drive a feeding motor 132 and to feed a printing sheet P on a conveyer belt (not shown).

The movement controller 83 controls a motor driver 123 to drive the carriage motor 8 and to move the carriage 5 in the main scanning direction.

The pump controller 84 controls a pump driver 124 to allow the suction pump 22 to perform the suction operation.

The vibration controller 85 controls a driver 125 to change the application of voltage across the electrode 92 and 93 and to allow the dielectric elastomer 90 to vibrate.

Figure 7:
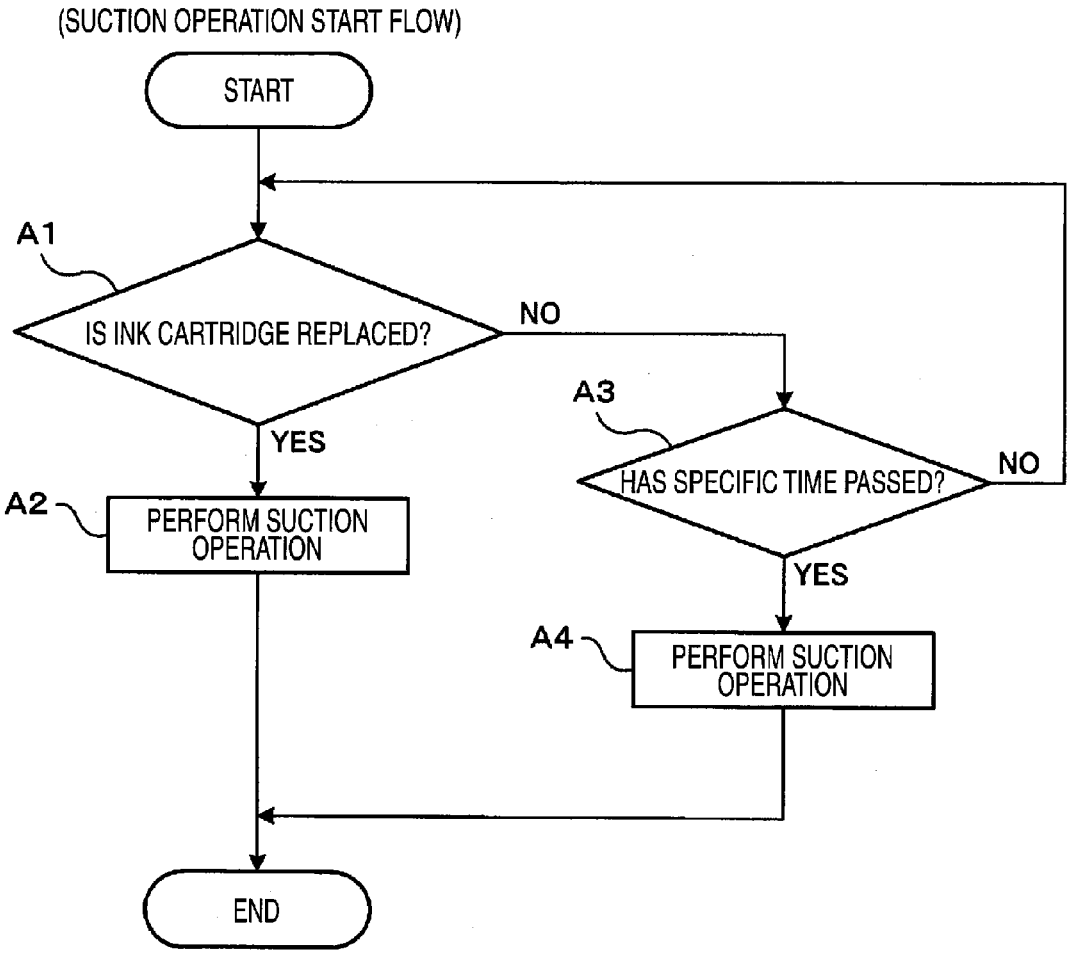
FIG. 7 is a flowchart illustrating a procedure of determining whether a suction process should be started.
Figure 8:
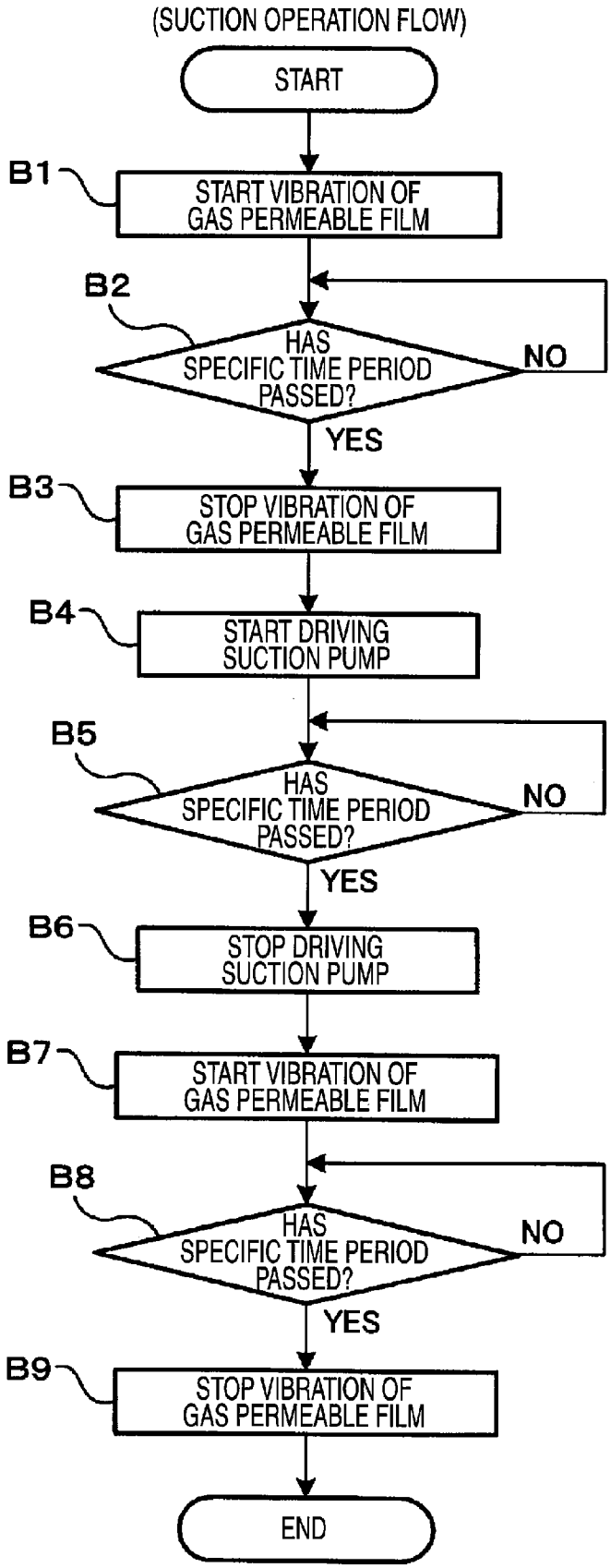
FIG. 8 is a flowchart illustrating a series of suction operations.

A series of operations of suctioning the gas gathered in the ink containing portions 50 of the sub-tanks 7*a* to 7*d* will be described now with reference to FIGS. 7 to 9. FIG. 7 is a flowchart illustrating a procedure of determining whether the suction process should be started, which is carried out by the controller 80. FIG. 8 is a flowchart illustrating a series of suction operations, which are carried out in accordance with a command from the controller 80. FIG. 9 is a schematic sectional diagram of the sub-tank illustrating a series of suction operations.

When bubbles are gathered in the ink containing portions 50*a* to 50*d* of the sub-tanks 7*a* to 7*d* and the bubbles goes into the ink flow channel of the ink-jet head 6, the clogging of the nozzles may be caused and thus a desired printing operation may not be performed. Accordingly, when it is considered that the bubbles are gathered in the ink containing portions 50*a* to 50*d*, the suction operation is performed to discharge the bubbles to the discharge channel 51. The timing for discharging the bubbles from the ink containing portions 50*a* to 50*d* may be a timing when the bubbles are easily included in the ink containing portions 50*a* to 50*d* such as when the ink cartridges 11*a* to 11*d* are replaced and when a specific time passes after the previous suction operation. It can be understood that there is high possibility that a large amount of bubbles are mixed when the ink cartridges 11*a* to 11*d* are replaced or when the suction operation is not performed for a long time.

By performing the suction operation from the discharge channel 51 to discharge the bubbles in the sub-tanks 7*a* to 7*d*, the ink in the ink containing portions 50*a* to 50*d* is attached to the gas permeable film 57. When the bubbles are mixed in the ink in the ink containing portions 50*a* to 50*d* again with the lapse of time, the ink attached to the gas permeable film 57 is gradually thickened and the portion of the gas permeable film 57 to which the thickened ink is attached causes the clogging which does not to pass the bubbles. Accordingly, it is necessary to remove the thickened ink attached to the gas permeable film 57 at the time of performing the suction operation.

As shown in FIG. 7, first, the controller 80 determines whether the ink cartridges 11*a* to 11*d* are replaced at A1. As described above, in determining whether the ink cartridges 11*a* to 11*d* are replaced, if the light emitted from the light emitting element 40*a* is not first received by the light receiving element 40*b*, is then received, and then is not received again, it is determined that the ink cartridges 11*a* to 11*d* are replaced. If it is determined that the ink cartridges 11*a* to 11*d* are replaced (Yes in A1), the pump controller 84 and the vibration controller 85 control the pump driver 124 and the driver 125 to perform the suction operation from the discharge channel 51 at A2. The suction operation from the discharge channel 51 will be described later. If it is determined that the ink cartridges 11*a* to 11*d* are not replaced (No in A1), it is determined whether a specific time period (suction operation interval) has passed after the previous suction operation from the discharge channel 51 at A3. If it is determined that the specific time passes (Yes in A3), the pump controller 54 and the vibration controller 55 control the pump driver 124 and the driver 125 to perform the suction operation from the discharge chamber 51 at A4. If it is determined that the predetermined time does not pass (No in A3), the process of A1 is performed again.

Figure 9A:
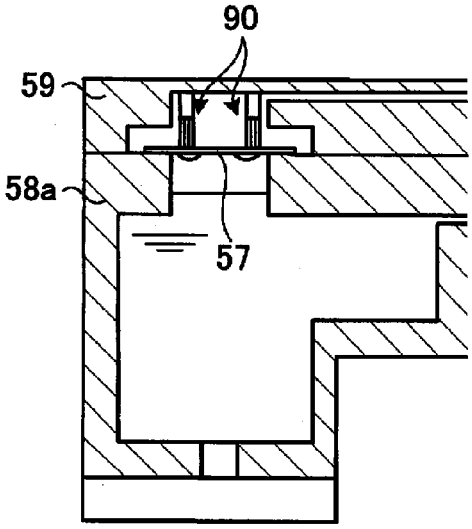
FIGS. 9A to 9D are schematic sectional views of the sub-tank illustrating a series of suction operations.
Figure 9B:
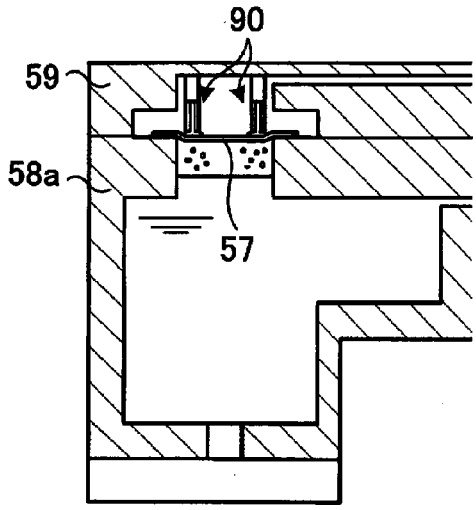
Figure 9C:
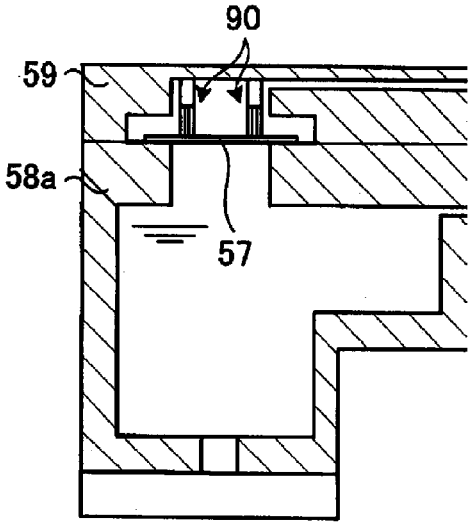
Figure 9D:
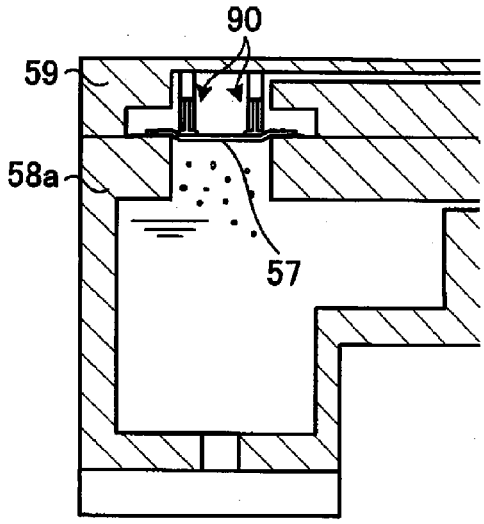

A series of suction operations will be described now. First, as shown in FIG. 8, the vibration controller 55 controls the driver 125 to allow the gas permeable film 57 disposed in each of the sub-tanks 7*a* to 7*d* to vibrate at B1. This vibration state is maintained for a specific time period. Then, the thickened ink attached to the gas permeable film 57 as shown in FIG. 9A is detached therefrom due to the vibration of the gas permeable film 57 (see FIG. 9B). At this time, since the gas permeable film 57 does not come in contact with the ink before the suction operation from the discharge channel 51, the thickened ink can be detached more effectively. Then, it is determined that whether the specific time period has passed at B2. If the specific time period (first film vibration time) has passed (Yes in B2), the vibration controller 55 controls the driver 125 to stop the vibration of the gas permeable film 57 at B3.

In the state where the suction pump 22 is connected to the discharge channel 51 by the switching unit 21, the pump controller 54 controls the pump driver 124 to allow the suction pump 40 to perform the suction operation from the discharge channel 51 disposed in each of the sub-tanks 7*a* to 7*d* at B4. If the gas in the discharge channel 51 is suctioned in the suction operation, the pressure of the discharge channel 51 is reduced and the bubbles in the ink containing portions 50*a* to 50*d* pass through the gas permeable film 57 and moves to the discharge channel 51, whereby the bubbles are suctioned. At this time, the ink does not move to the discharge channel 51 due to the gas permeable film 57. In this way, by vibrating the gas permeable film 57 to recover the gas permeability of the gas permeable film 57 and then performing the suction operation of the suction pump 22, it is possible to efficiently discharge the bubbles. By stopping the vibration of the gas permeable film 57 just before the suction operation, it is possible to prevent the bubbles from being generated in the ink containing portions 50*a* to 50*d* at the time of suction, thereby preventing the bubbles from being mixed into the ink containing portions 50*a* to 50*d*.

The state where the suction operation from the discharge channel 51 is being performed is maintained for a specific time period (specific suction time) at B5. The specific time period is set to a magnitude required for discharging the bubbles in the ink containing portions 50*a* to 50*d* and bringing the ink in the ink containing portions 50*a* to 50*d* into contact with the corresponding gas permeable film 57. If the specific time period has passed (Yes in B5), the suction operation of the suction pump 40 is stopped at B6 (see FIG. 9C).

The vibration controller 55 controls the driver 125 to vibrate the gas permeable film 57 again at B7. This vibrating state is maintained for a specific time period (second film vibration time) (see FIG. 9D). Since the ink in the vicinity of the gas permeable film 57 can easily come in contact with the gas and can be easily dried, the thickened ink can be easily gathered. In the vicinity of the gas permeable film 57, the influence of an air flow generated at the time of ejecting the ink from the nozzles of the ink-jet head 6 is small and a stagnation of the ink is likely to occur. Accordingly, by vibrating the gas permeable film 57 again after the suction operation, it is possible to agitate the ink stagnated in the vicinity of the gas permeable film 57. If the specific time period has passed (Yes in B8), the vibration controller 55 controls to stop the vibration of the gas permeable film 57 at B9. The magnitude of the specific time period (second film vibration time) can be properly set, but may be set to the same magnitude as the above-mentioned specific time period (first film vibration time) for the purpose of simple control.

According to the above-described ink-jet printer 1, the vibration controller 55 controls the driver 125 to repeat the contracting and expanding operation of the base member 91 so that the gas permeable film 57 vibrates, whereby the thickened ink attached to the gas permeable film 57 is detached therefrom to reduce the clogging. Accordingly, the lifetime of the gas permeable film 57 is elongated.

Since the suction pump 22 performs the suction operation only at the time of replacing the ink cartridges 11*a* to 11*d* or when a specific time period (suction operation interval) has passed after the previous suction operation and performs the suction operation only when it is considered that the bubbles mixed into the ink containing portions 50*a* to 50*d* should be discharged, it is possible to suppress the attachment of ink to the gas permeable film 57 to the minimum. Accordingly, the ink hardly permeates the gas permeable film 57, thereby elongating the lifetime of the gas permeable film 57. At the time of replacing the ink cartridges 11*a* to 11*d* or when the specific time period has passed after the previous suction operation, it can be determined that there is high possibility that a large amount of bubbles are mixed into the ink containing portions 50*a* to 50*d*. In this case, by allowing the suction pump 22 to perform the suction operation, it is possible to efficiently discharge the bubbles by a small number of times.

Since the dielectric elastomer 90 having the base member 91 made of polymer elastomer having a great amount of contraction and expansion is used to vibrate the gas permeable film 57, it is possible to vibrate the gas permeable film 57 greatly, thereby enhancing the effect of releasing the clogging.

When a voltage is not applied across two electrodes 92 and 93, a gap is formed between the dielectric elastomer 90 and the gas permeable film 57. When a voltage is applied across two electrodes 92 and 93, the base member 91 is deformed and the dielectric elastomer 90 comes in contact with the gas permeable film 57. Accordingly, it is possible to reduce the deterioration in gas permeable area (gas permeability) of the gas permeable film 57 by employing the dielectric elastomer 90.

Since the bottom surface of the gas permeable film 57 is bonded to the top surface of the tank body 58 constituting a part of the discharge chamber 56 and the dielectric elastomer 90 comes in contact with the top surface of the gas permeable film 57, the dielectric elastomer 90 comes in contact with the surface of the gas permeable film 57 opposite to the bonding surface to the tank body 58. In this case, the dielectric elastomer 90 coming in contact with the gas permeable film 57 presses the gas permeable film 57 to the tank body 58 and thus the gas permeable film 57 is made to vibrate. Accordingly, during the vibration, the force in the direction in which the gas permeable film is peeled off from the tank body 58 does not act on the gas permeable film 57, thereby hardly peeling off the gas permeable film 57 from the tank body 58.

While the present invention has been shown and described with reference to certain exemplary embodiments thereof, it will be understood by those skilled in the art that various changes in form and details may be made therein without departing from the spirit and scope of the invention as defined by the appended claims.

Various modified exemplary embodiments will be described. Here, elements similar to above-described exemplary embodiment are denoted by the same reference numerals and description thereof is properly omitted.

Figure 10A:
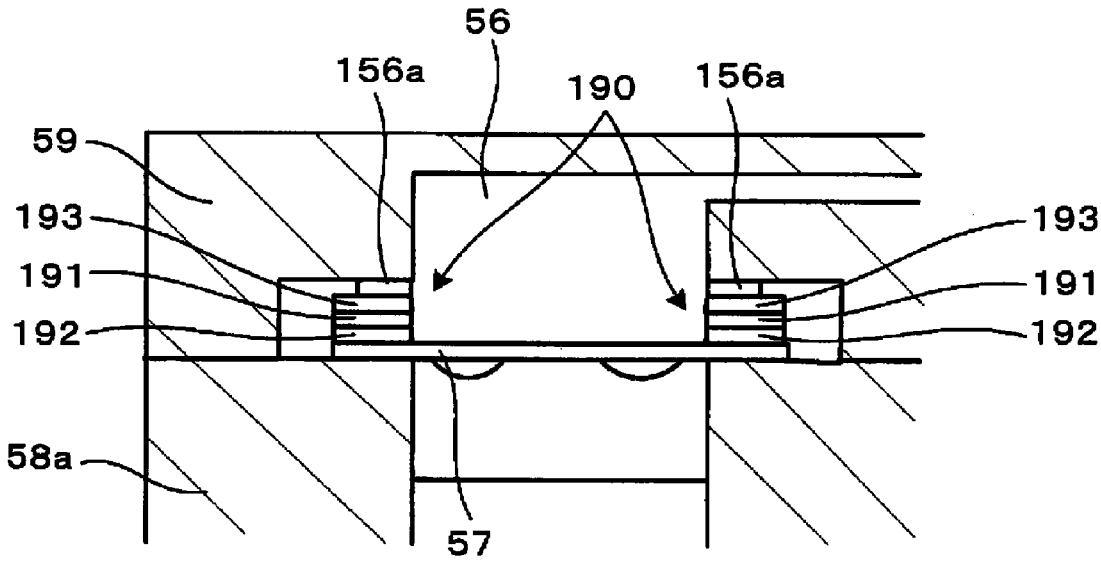
FIGS. 10A and 10B are diagrams illustrating a modified example in arrangement of the dielectric elastomer.
Figure 10B:
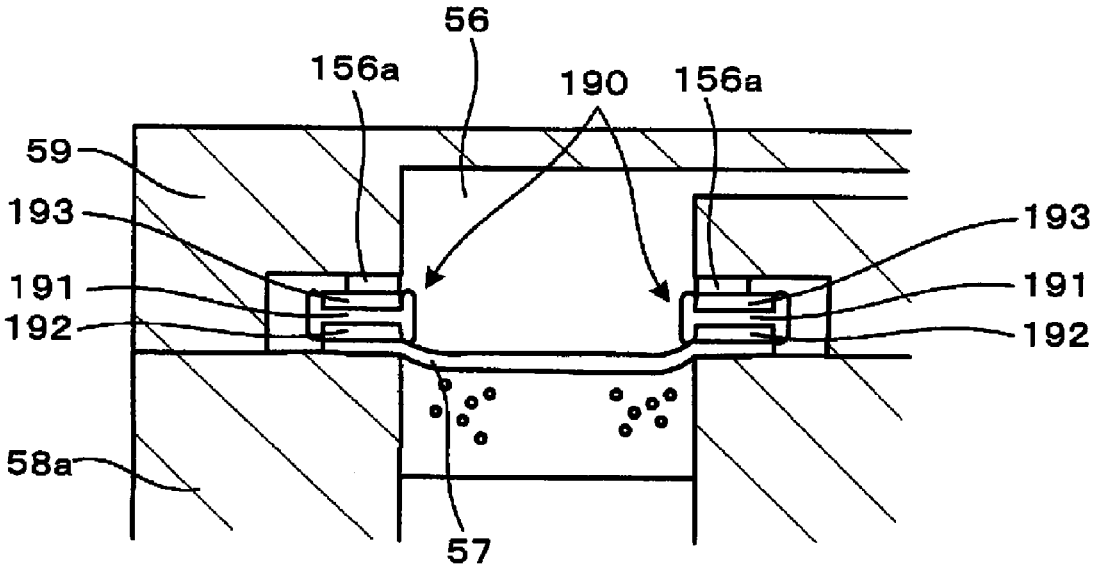

As shown in FIG. 10A, a protruding portion 156*a* may be disposed at a position overlapping with the bonding portion of the discharge chamber 56 between the gas permeable film 57 and the tank body 58*a* in the vertical direction and a dielectric elastomer 190 may be disposed between the protruding portion 156*a* and the gas permeable film 57. In this case, the dielectric elastomer 190 is disposed at the position opposite to the bonding portion between the gas permeable film 57 and the tank body 58*a* in the vertical direction so that the thickness direction thereof is parallel to the pressing direction of the gas permeable film 57. By applying a voltage across electrodes 192 and 193, an expanded base member 191 protrudes from both side surfaces in the direction perpendicular to the thickness direction of the dielectric elastomer 190, and the protruding base member 191 comes in contact with the gas permeable film 57. The base member presses down the gas permeable film 57 with its further protruding (see FIG. 10B). Accordingly, in the state where a voltage is not applied across the electrodes 192 and 193 and the base member 191 is not deformed, the gas permeable area of the gas permeable film 57 is not reduced when the suction pump 22 performs the suction operation.

In the above-described exemplary embodiment, when a voltage is not applied across the electrodes 92 and 93, the dielectric elastomer 90 and the gas permeable film 57 are opposed to each other with a specific gap interposed therebetween. However, when it is intended to enhance the pressing force on the gas permeable film 57 and to enhance the vibration amplitude, the gap may not be formed between the dielectric elastomer 90 and the gas permeable film 57. In this case, the dielectric elastomer 90 and the gas permeable film 57 may be bonded to each other.

The timing when the suction pump 22 performs the suction operation from the discharge channel 51 is not limited to the timing of replacing the ink cartridge and the timing when a specific time has passed after the previous suction operation. For example, the suction operation may be performed every constant period.

In a system in which bubbles are not gathered in the ink containing portions 50*a* to 50*d* by always performing the suction operation from the discharge channel 51 to maintain the discharge channel 51 in a negative pressure, the suction pump 22 may perform the suction operation from the discharge channel 51 at a desired timing. Accordingly, the air stream generated in the vicinity of the gas permeable film 57 at the time of ejecting the ink from the nozzles of the ink-jet head 6 hardly influences, thereby agitating the stagnated ink.

In addition, although the above-described exemplary embodiment employs the dielectric elastomer 90, the inventive concept of the present invention is not limited to the dielectric elastomer 90. So long as a member can vibrate the gas permeable film 57, any element such as a piezoelectric element may be employed.

Although it has been described in the above-described exemplary embodiment that the gas permeable film 57 is made to vibrate before and after the suction operation of the suction pump 22, the gas permeable film 57 may be made to vibrate at only one time before or after the suction operation.

In the above-described exemplary embodiment, the replacement of the ink cartridges 11*a* to 11*d* is determined by the use of the optical sensor 40. However, a configuration may be employed, in which electrodes are disposed in both the holder and the ink cartridge, the electrodes come in contact with each other by mounting the ink cartridge on the holder, and the replacement of the ink cartridge is determined by detecting the mounting and demounting of the ink cartridge.

In the above-described exemplary embodiment the ink-jet printer 1 is described. However, the inventive concept of the present invention may be applied to various types of liquid ejecting devices for ejecting liquid other than ink such as an apparatus for coating color liquids for production of color filters for liquid crystal displays.

What is claimed is:

1. A liquid ejecting device comprising:

a liquid ejecting head configured to eject a liquid;

a liquid supply channel configured to supply the liquid to the liquid ejecting head;

a discharge channel communicating with the liquid supply channel through a communicating portion;

a suction unit connected to the discharge channel so as to perform a suction operation of suctioning gas from the discharge channel;

a gas permeable film disposed in the communicating portion between the liquid supply channel and the discharge channel;

a vibration driving unit configured to vibrate the gas permeable film; and a controller configured to control the suction unit and the vibration driving unit, wherein the vibration driving unit comprises:

a plurality of electrodes; and a vibration element configured to deform in response to a voltage applied across the plurality of electrodes to vibrate the gas permeable film.

2. The liquid ejecting device according to claim 1, wherein the controller determines whether bubbles in the liquid supply channel should be discharged therefrom, and wherein the controller controls the suction unit to perform the suction operation only when it is determined that the bubbles in the liquid supply channel should be discharged.

3. The liquid ejecting device according to claim 2, wherein an end portion of the liquid supply channel is connected to the liquid ejecting head and the other end portion of the liquid supply channel is detachably connected to a liquid cartridge, and wherein when the liquid cartridge is replaced, the controller determines that the bubbles in the liquid supply channel should be discharged and controls the suction unit to perform the suction operation.

4. The liquid ejecting device according to claim 2, wherein when a specific time has passed after a previous suction operation is performed by the suction unit, the controller determines that the bubbles should be discharged from the liquid supply channel and controls the suction unit to perform the suction operation.

5. The liquid ejecting device according to claim 2, wherein the controller controls the vibration driving unit to vibrate the gas permeable film before the suction unit performs the suction operation, and then controls the suction unit to perform the suction operation after stopping the vibration driving unit.

6. The liquid ejecting device according to claim 5, wherein the controller controls the vibration driving unit to vibrate the gas permeable film after the suction unit stops the suction operation.

7. The liquid ejecting device according to claim 1, wherein the vibration driving unit comprises a dielectric elastomer including:

a base member made of a polymer elastomer as the vibration element; and two of the plurality electrodes provided on both surfaces of the base member, and wherein the base member of the vibration driving unit deforms in response to a voltage applied across the two electrodes and vibrates the gas permeable film.

8. The liquid ejecting device according to claim 7, wherein the dielectric elastomer is not bonded to the gas permeable film, and wherein the dielectric elastomer comes in contact with the gas permeable film with the deformation of the base member in response to the voltage applied across the two electrodes.

9. The liquid ejecting device according to claim 8, wherein a gap is formed between the dielectric elastomer and the gas permeable film when no voltage is applied across the two electrodes, and wherein the dielectric elastomer comes in contact with the gas permeable film with the deformation of the base member in response to the voltage applied across the two electrodes.

10. The liquid ejecting device according to claim 8, wherein one surface of the gas permeable film is bonded to a flow channel forming member which forms at least the communication portion in the liquid supply channel, and wherein the dielectric elastomer comes in contact with the other surface of the gas permeable film.

11. A liquid tank comprising:

a liquid containing unit which contains a liquid and supplies the liquid to an ejecting head which ejects the liquid, the liquid containing unit including a gas discharge opening;

a gas permeable film which covers the gas discharge opening;

a discharge channel, one end of which communicates with the liquid tank through the gas discharge opening, and the other end of which is connectable to a suction pump which suctions air in the liquid containing unit through the discharge channel; and a vibration driving unit which comprises:

a plurality of electrodes; and a vibration element configured to deform in response to a voltage applied across the plurality of electrodes to vibrate the gas permeable film.

12. The liquid tank according to claim 11, wherein the vibration driving unit physically contacts with the gas permeable film to vibrate.

* * * * *